US010256574B2

(12) United States Patent
Nishida et al.

(10) Patent No.: US 10,256,574 B2
(45) Date of Patent: Apr. 9, 2019

(54) CONNECTOR AND SHIELDING SHELL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shiro Nishida, Mie (JP); Seido Nishijima, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/546,294

(22) PCT Filed: Jan. 22, 2016

(86) PCT No.: PCT/JP2016/051772
§ 371 (c)(1),
(2) Date: Jul. 26, 2017

(87) PCT Pub. No.: WO2016/129356
PCT Pub. Date: Aug. 18, 2016

(65) Prior Publication Data

US 2018/0269632 A1 Sep. 20, 2018

(30) Foreign Application Priority Data

Feb. 12, 2015 (JP) ..... 2015-024981

(51) Int. Cl.
*H01R 13/506* (2006.01)
*H01R 13/627* (2006.01)
(Continued)

(52) U.S. Cl.
CPC ..... *H01R 13/6581* (2013.01); *H01R 13/506* (2013.01); *H01R 13/6271* (2013.01); *H01R 13/6592* (2013.01); *H01R 13/6593* (2013.01)

(58) Field of Classification Search
CPC ..... H01R 13/6581; H01R 13/659; H01R 13/6593
See application file for complete search history.

(56) References Cited

U.S. PATENT DOCUMENTS 5,035,652 A 7/1991 Shibano
9,385,480 B2 * 7/2016 Miyoshi ..... H01R 13/658

FOREIGN PATENT DOCUMENTS

JP 2-150682 12/1990
JP 5-45952 6/1993
(Continued)

OTHER PUBLICATIONS

International Search Report dated Apr. 5, 2016.

*Primary Examiner* — Vanessa Girardi
(74) *Attorney, Agent, or Firm* — Gerald E. Hespos; Michael J. Porco; Matthew T. Hespos

(57) ABSTRACT

A shield connector includes a shielded cable (11) with wires (12) enclosed by a shield layer (13). An inner housing (16) accommodates terminals (15) connected to the wires (12). A shield shell (20) covers the inner housing (16) and includes a connecting portion (23) to be connected electrically to the shield layer (13). An outer housing (30) accommodates the shield shell (20) and is locked to a mating connector. The outer housing (30) includes a body (31) enabling the shield shell (20) to be inserted therein through an opening (31A) on a rear side, and two covers (40A, 40B) integrally hinged to the body (31) to close the opening (31A) and cover the connecting portion (23). Each cover (40A, 40B) includes a
(Continued)

first lock (43, 44) to be locked to the mating cover and a second lock (45) to be locked to the body.

5 Claims, 12 Drawing Sheets

(51) Int. Cl.
*H01R 13/6581* (2011.01)
*H01R 13/6592* (2011.01)
*H01R 13/6593* (2011.01)

(56) References Cited

FOREIGN PATENT DOCUMENTS

| | | |
|---|---|---|
| JP | 2006-216332 | 8/2006 |
| JP | 2010-282884 | 12/2010 |
| JP | 2014-53186 | 3/2014 |

* cited by examiner

CONNECTOR AND SHIELDING SHELL

BACKGROUND

1. Field of the Invention

A technique disclosed in this specification relates to a connector and a shielding shell to be accommodated into a connector.

2. Description of the Related Art

Conventionally, a connector of a so-called shell built-in type is known in which a shell (shielding shell) for reducing radiation noise radiated from a signal line and the like is accommodated in a housing. For example, a shield connection structure which is mounted between a first shielding layer and a second shielding layer and in which a slider shell and an inner shell are accommodated in a housing is disclosed, for example, in Japanese Unexamined Patent Publication No. 2014-53186. These slider shell and inner shell are formed into a tube shape (linear shape) so that a signal line or the like can be passed inside.

However, the above shield connection structure having a tube shape has both end parts respectively connected to the first and second shielding layers, and a connecting direction to the first shielding layer and that to the second shielding layer are parallel. If it is tried, for example, to connect one connection side of the connector having two parallel connecting directions as just described to a device or the like and pull out a conductive member such as a signal line from the other connection side, a width of the connector in the connecting direction to the device becomes larger. Further, considering the routing of the conductive members extending from the other connection side, a sufficient space is necessary to arrange the connector in the connecting direction to the device.

The technique disclosed in this specification was created in view of the above problem and aims to realize space saving while realizing a configuration in which a shielding shell is accommodated in a housing.

SUMMARY

The technique disclosed in this specification is directed to a connector with a housing internally provided with an accommodation space including a first opening open toward a connection side to a device and a second opening, a conductive member electrically connected to the device being pulled out from the second opening in a direction intersecting with a connecting direction to the device, and a shielding shell shaped to extend in each of the connecting direction to the device and a pull-out direction of the conductive member, arranged in the accommodation space and configured to cover the conductive member in the accommodation space, wherein the shielding shell is formed by assembling, in the accommodation space, a first shell member extending straight and accommodated into the accommodation space from the first opening and a second shell member extending straight and accommodated into the accommodation space from the second opening.

The above connector is a so-called L-shaped connector in which the connecting direction of the device and the pull-out direction of the conductive member intersect. Further, the above connector can be manufactured by accommodating the substantially L-shaped shielding shell into the accommodation space of the housing in a manufacturing process thereof. Specifically, the conductive member is accommodated into the accommodation space in the housing provided with two openings (first opening, second opening) open in the directions intersecting with each other, the first shell member extending straight is accommodated to cover the conductive member from the first opening, and the second shell member extending straight is accommodated to cover the conductive member from the second opening. Thereafter, the one end part of the first shell member and that of the second shell member are assembled in the accommodation space. As a result, the substantially L-shaped connector of a shell built-in type can be realized.

In the above connector manufactured in this way, the side provided with the first opening can be connected to the device and the conductive member can be pulled out in the direction intersecting with the connecting direction to the device with an existing straight connector connected on the second opening side. Thus, a width of the above connector in the connecting direction to the device can be suppressed, and space saving can be realized in the connecting direction to the device, for example, as compared to a conventional connector of a shell built-in type from which a conductive member is pulled out in a direction parallel to a connecting direction to a device. As just described, the above connector can save space while realizing a configuration in which the shielding shell is accommodated in the housing.

In the above connector, an engaging portion may be provided on either one of the first and second shell members, and an engaged portion to be engaged with the engaging portion by the first shell member being accommodated into the accommodation space from the first opening and the second shell member being accommodated into the accommodation space from the second opening may be provided on the other of the first and second shell members.

According to this configuration, the engaging portion can be engaged with the engaged portion by accommodating the first shell member from the first opening and the second shell member from the second opening in the manufacturing process of the connector, and the both shell members can be assembled in the housing without separately performing an assembling operation of the both shell members. Thus, easiness to assemble the shielding shell can be improved.

In the above connector, the accommodation space may further include a third opening provided on a side opposite to the connection side to the device and open at a position facing an assembled part of the first and second shell members.

According to this configuration, in the manufacturing process of the connector, the first and second shell members can be, for example, firmly assembled by a screw or the like or the screw can be unfastened using a tool or the like from the third opening. Further, the first or second shell member engaged in the accommodation space of the housing can be, for example, disengaged using a tool or the like from the third opening. Thus, operability in mounting and removing the first and second shell members into and from the housing can be improved.

In the above connector, the conductive member may be formed into a busbar extending in each of the connecting direction to the device and the pull-out direction of the conductive member by being partially bent, the first shell member may be provided with a cut open toward the second opening at least in the assembled part with the second shell member in a state where the first shell member is accommodated in the accommodation space, and the second shell member may be provided with a cut open toward the first opening at least in the assembled part with the first shell member in a state where the second shell member is accommodated in the accommodation space.

If the first and second opening sides are not open in the assembled part of the first and second shell members with the both shell members assembled, the busbar bent to extend in each of the connecting direction to the device and the pull-out direction of the conductive member cannot be arranged in the accommodation space while being covered by the both shell members. According to the above configuration, since each of the first and second shell members is provided with the cut, the bent busbar can be arranged in the accommodation space without interfering with the shielding shell and it is possible to provide a specific configuration for realizing a substantially L-shaped connector with a built-in substantially L-shaped shielding shell.

Another technique disclosed in this specification is directed to a shielding shell with a first shell member shaped to extend straight, and a second shell member shaped to extend straight, the shielding shell being formed by assembling one end part of the first shell member and one end part of the second shell member in such a posture that the first and second shell members are perpendicular to each other.

The above shielding shell can be arranged to have a substantially L shape, for example, in a housing provided with two openings open in directions intersecting with each other by accommodating a conductive member into the housing, accommodating the first and second shell members into the housing from the different openings and assembling the one end part of the first shell member and that of the second shell member in the housing.

In such a connector with the built-in shielding shell, a side provided with one opening can be connected to a device and the conductive member can be pulled out in a direction intersecting with a connecting direction to the device with an existing straight connector connected to the other opening side. Thus, space saving can be realized in the connecting direction to the device, for example, as compared to a conventional connector of a shell built-in type in which a conductive member is pulled out in a direction parallel to a connecting direction to a device.

According to the technique disclosed in this specification, it is possible to realize space saving while realizing a configuration in which a shielding shell is accommodated in a housing.

DETAILED DESCRIPTION

Figure 3:
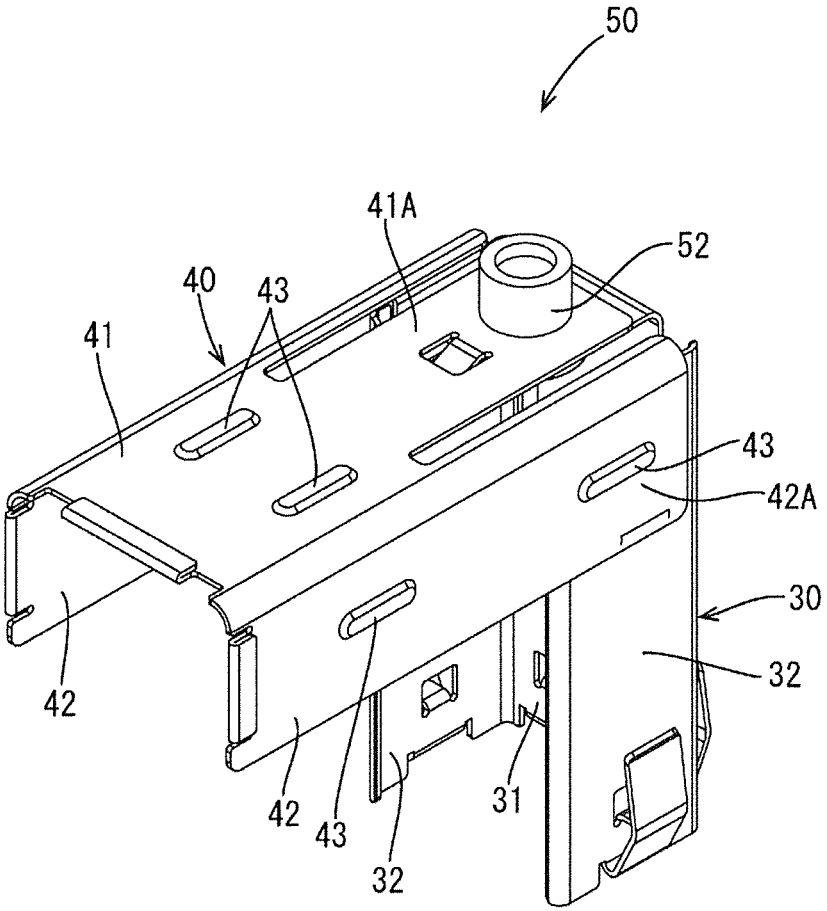
FIG. 3 is a perspective view of a shielding shell.
Figure 4:
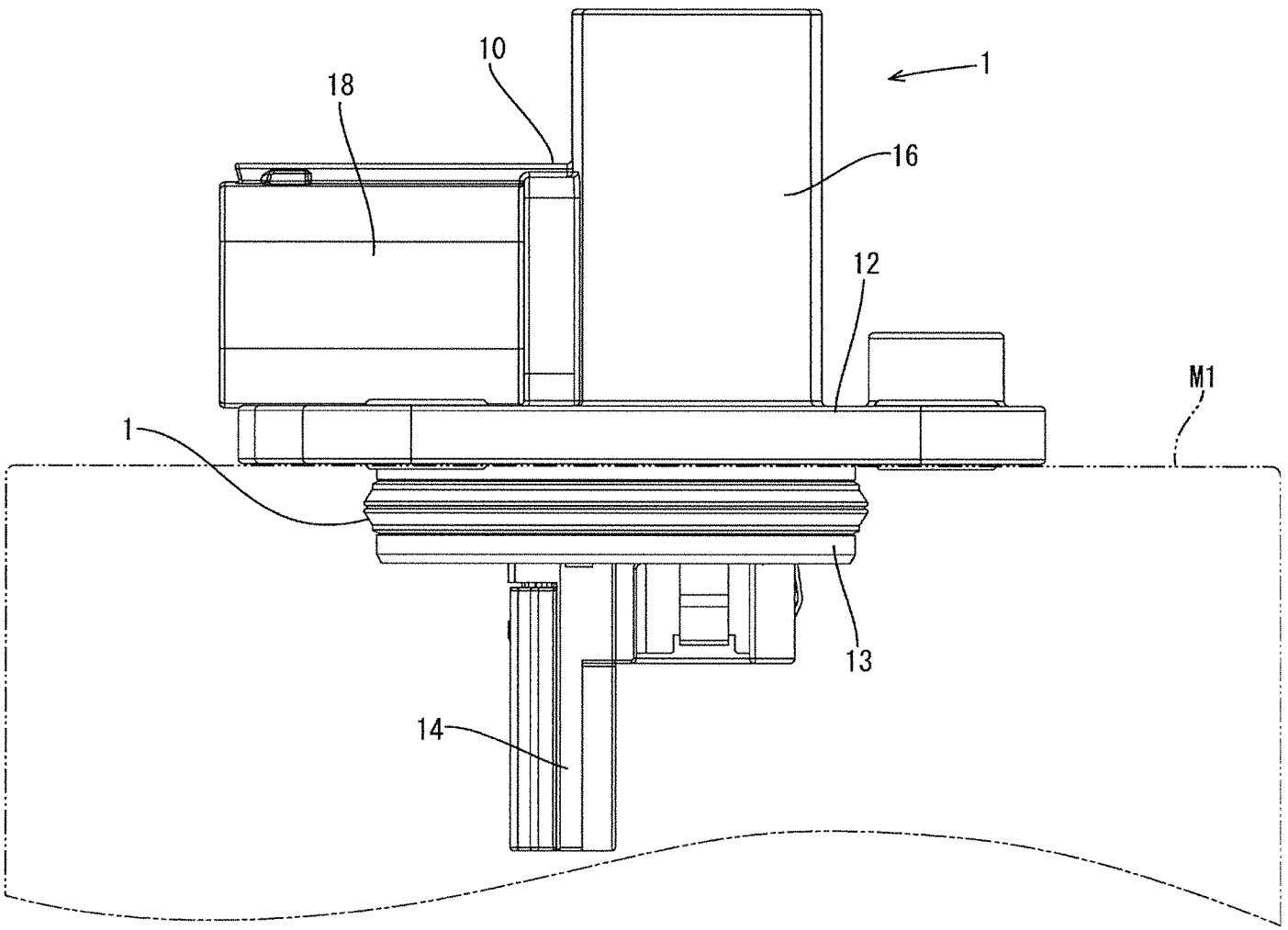
FIG. 4 is a side view of the connector viewed from right.

An embodiment is described with reference to the drawings. A connector 1 for connecting between terminals on the side of a device M1 (see FIG. 4) such as an inverter installed in a vehicle such as a hybrid or electric vehicle and wires (not shown) on a power supply side is illustrated in this embodiment. The connector 1 of this embodiment includes a housing 10 (see FIG. 1) made of synthetic resin, a busbar 20 (an example of a conductive member, see FIGS. 2 and 5) accommodated in the housing 10 and having the wires connected to one end part, and a shielding shell 50 (see FIG. 3) accommodated in the housing 10 and formed by assembling a first shell member 30 and a second shell member 40.

Figure 5:
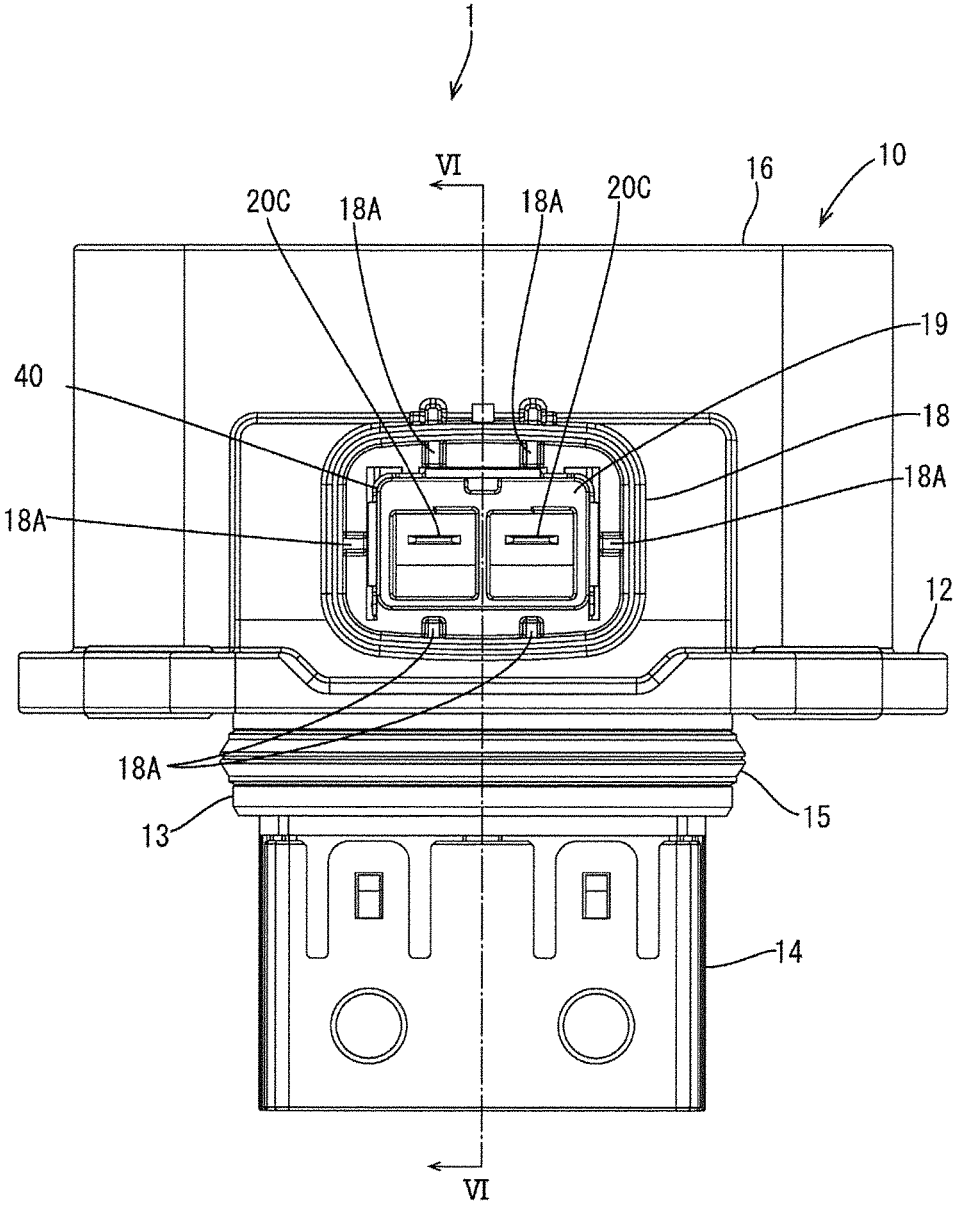
FIG. 5 is a front view of the connector.
Figure 6:
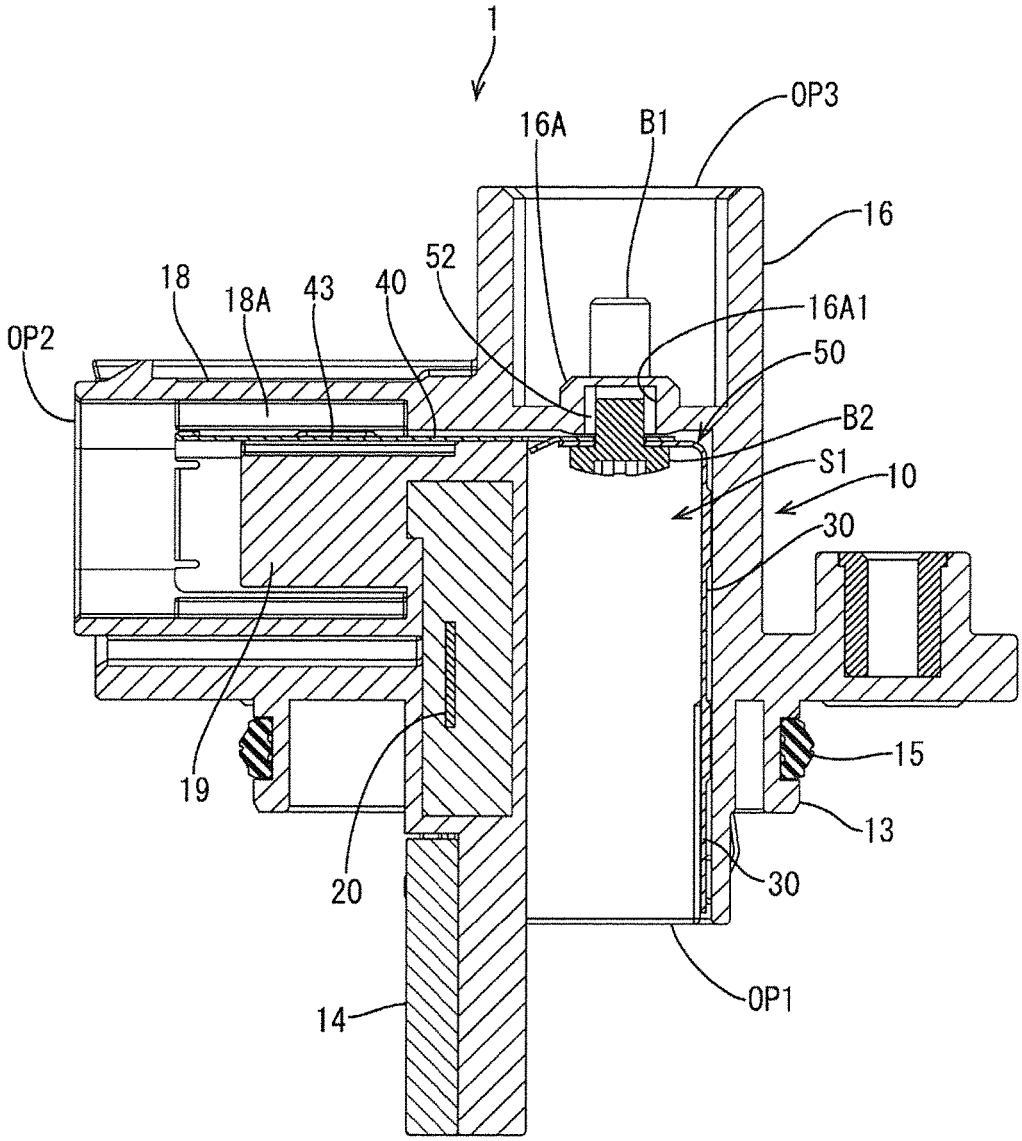
FIG. 6 is a section along VI-VI in FIG. 5.
Figure 7:
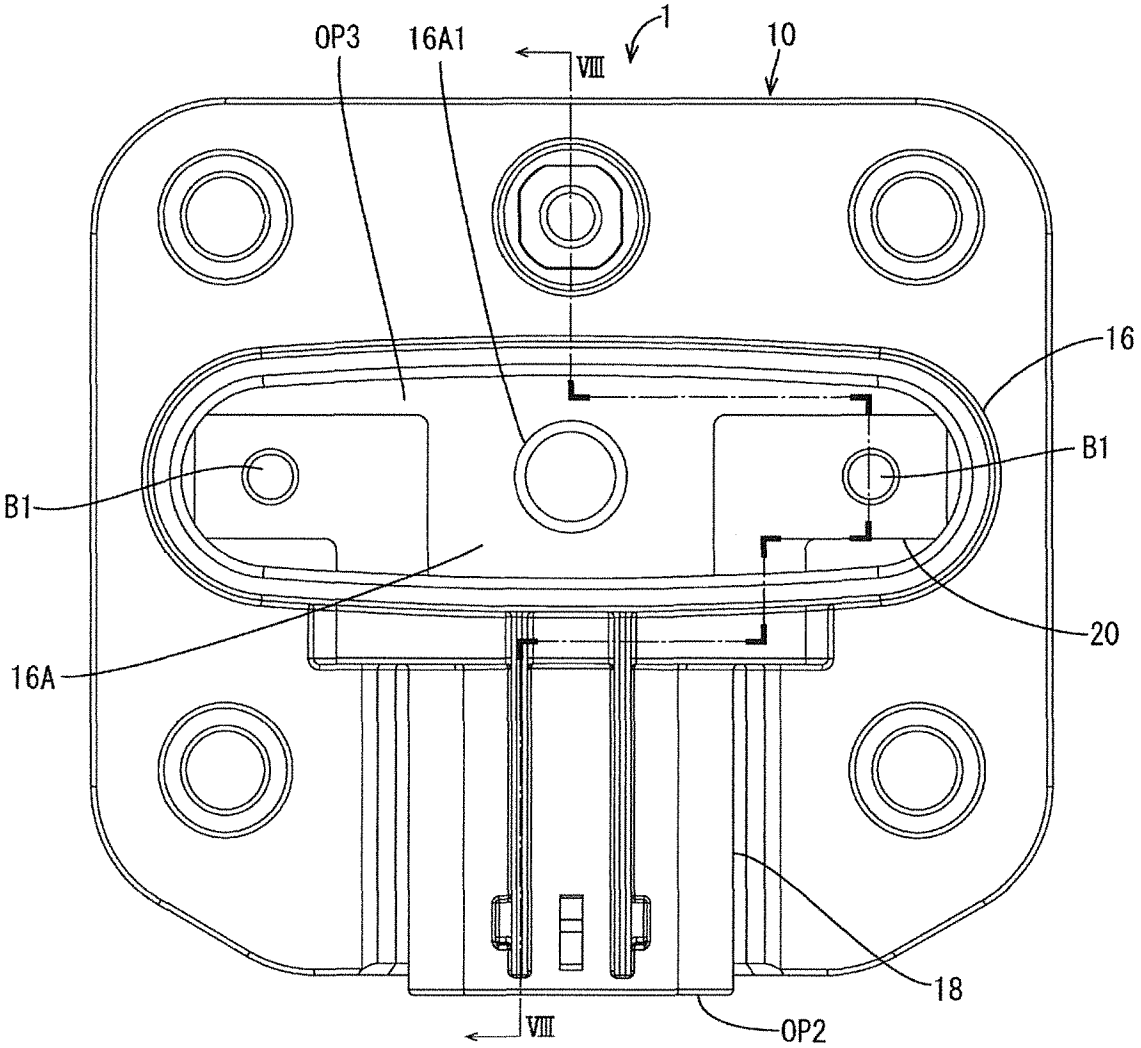
FIG. 7 is a plan view of the connector 1 viewed from above.
Figure 8:
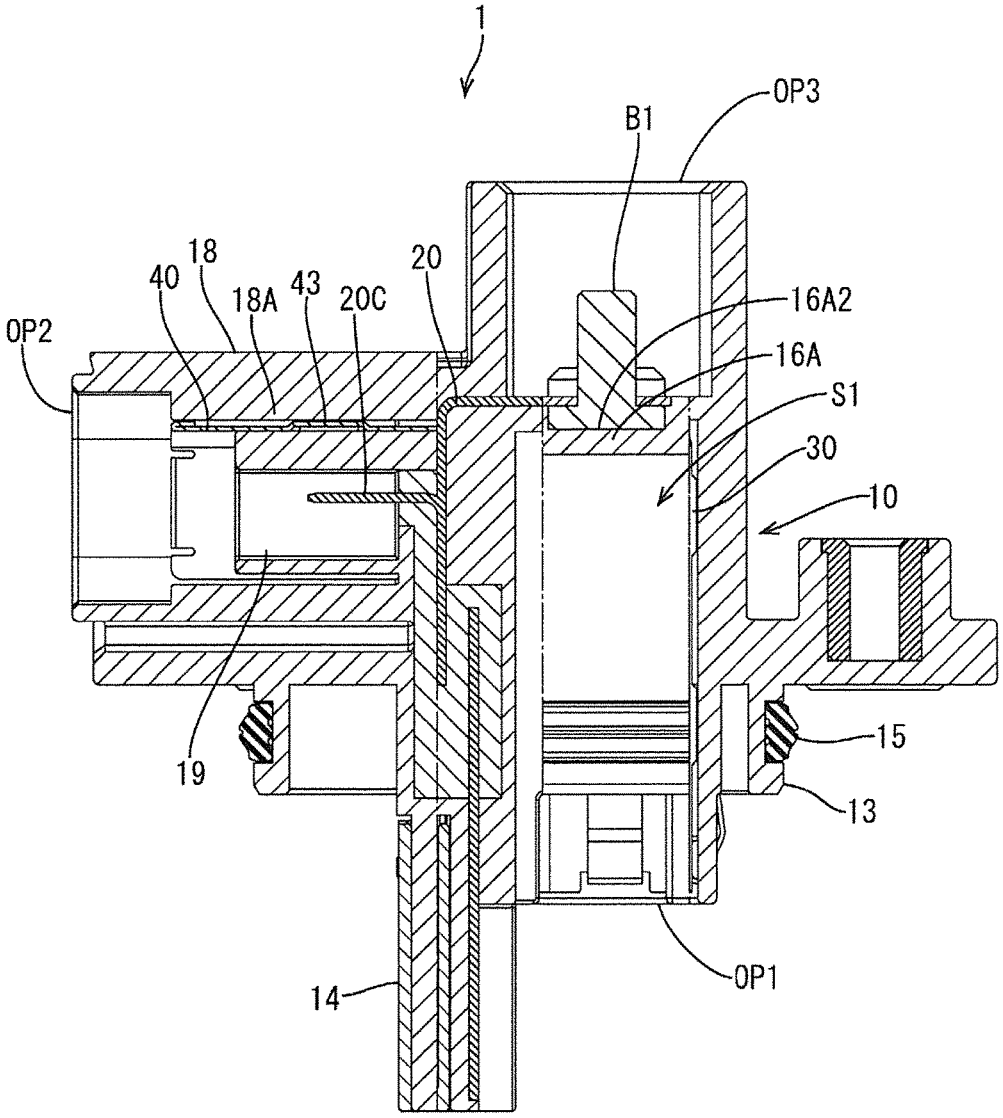
FIG. 8 is a section along VIII-VIII in FIG. 7.
Figure 9:
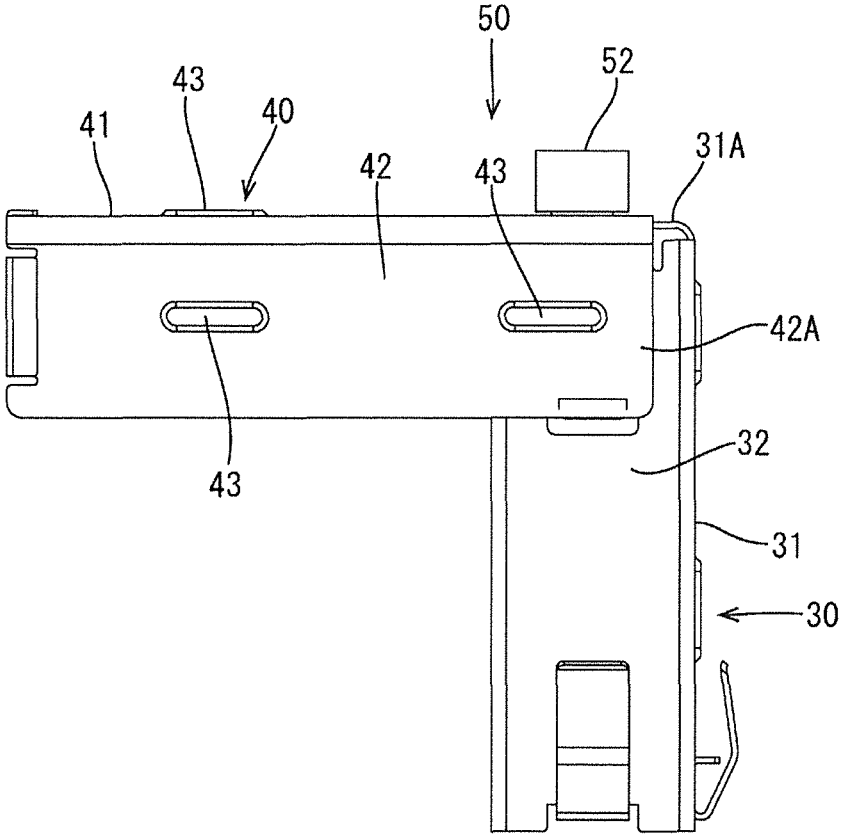
FIG. 9 is a side view of the shielding shell viewed from right.
Figure 10:
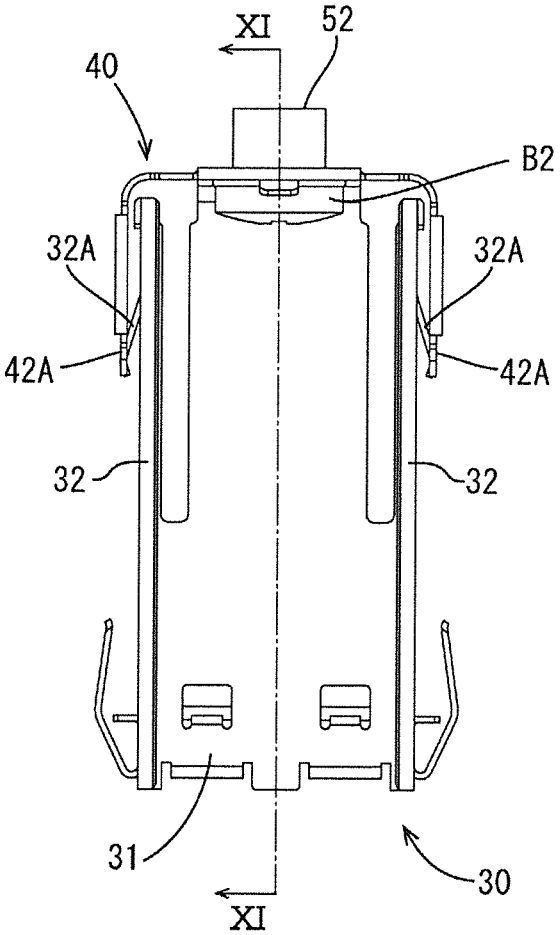
FIG. 10 is a front view of the shielding shell.
Figure 11:
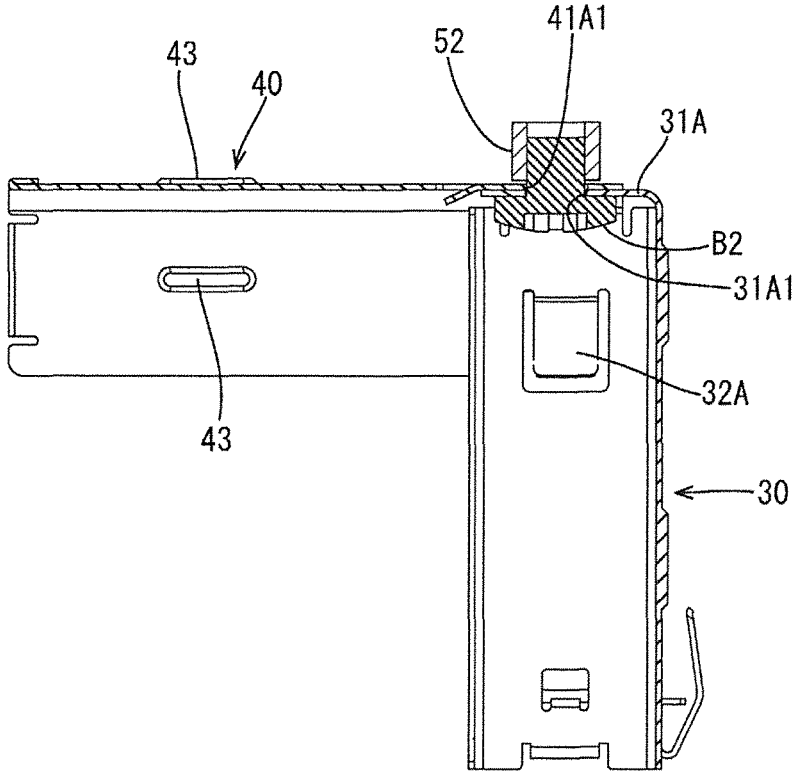
FIG. 11 is a section along XI-XI in FIG. 10.
Figure 12:
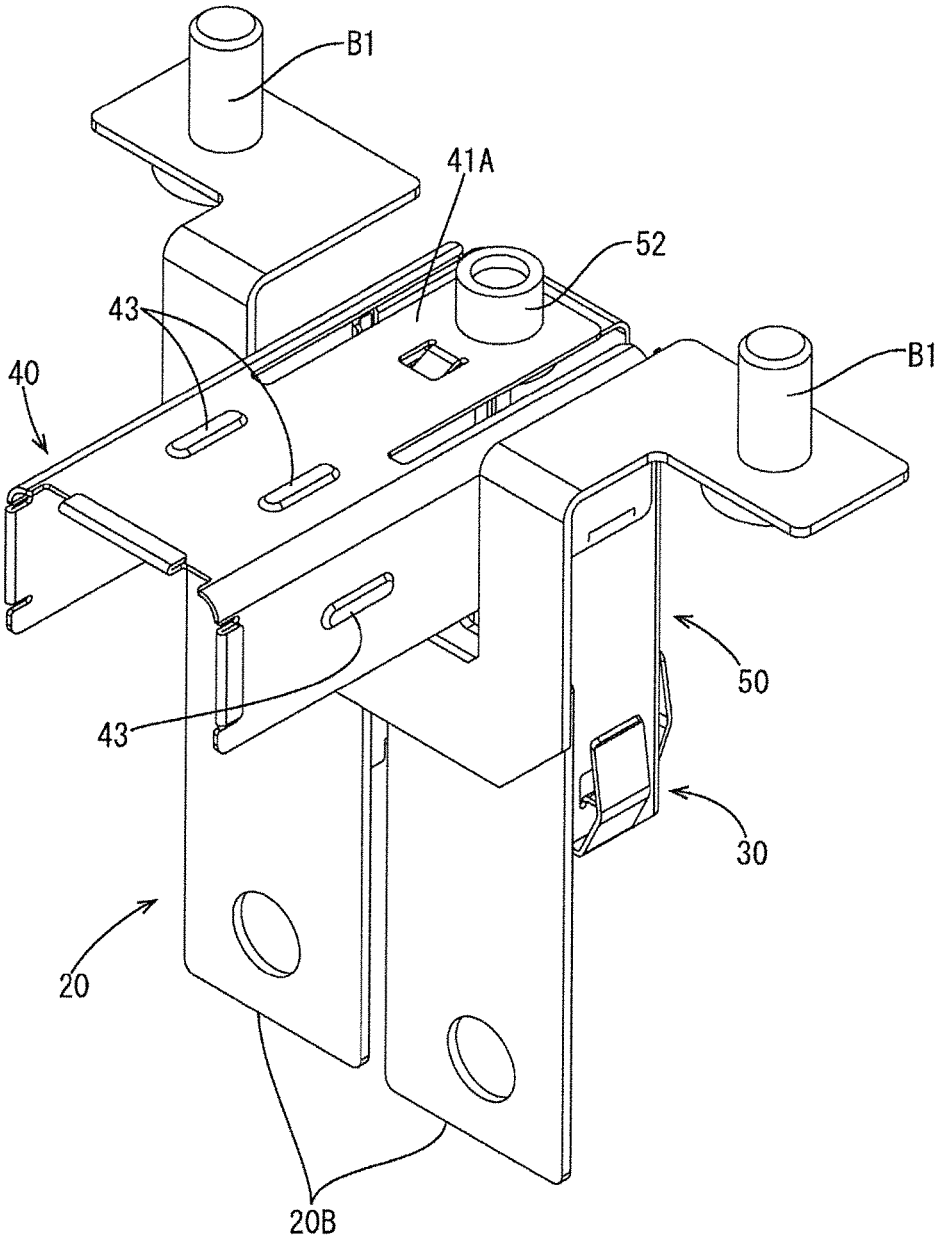
FIG. 12 is a perspective view showing an arrangement mode of the busbar and the shielding shell in an accommodation space.

Note that, in the following description, an upper side of each figure excluding FIGS. 7, 8 and 10 and a left side of FIG. 8 are an upper side of the connector 1, a right-lower side of each perspective view and a right side of FIGS. 5, 7 and 10 are a right side of the connector 1, and a left-lower side of each perspective view, a left side of FIGS. 4, 6, 9 and 11 and a lower side of FIGS. 7, 8 and 10 are a front side of the connector 1. Further, in the connector 1 of this embodiment, a lower side is a connection side to the device M1 and the busbar 20 is pulled out from the front of the connector 1. That is, in the connector 1, a vertical direction is a connecting direction to the device M1 and a direction (front-rear direction) intersecting with the connecting direction to the device (vertical direction) is a pull-out direction of the busbar 20 (wire pull-out direction). Thus, in the connector 1, the connecting direction to the device M1 and the pull-out direction of the busbar 20 perpendicularly intersect.

Figure 1:
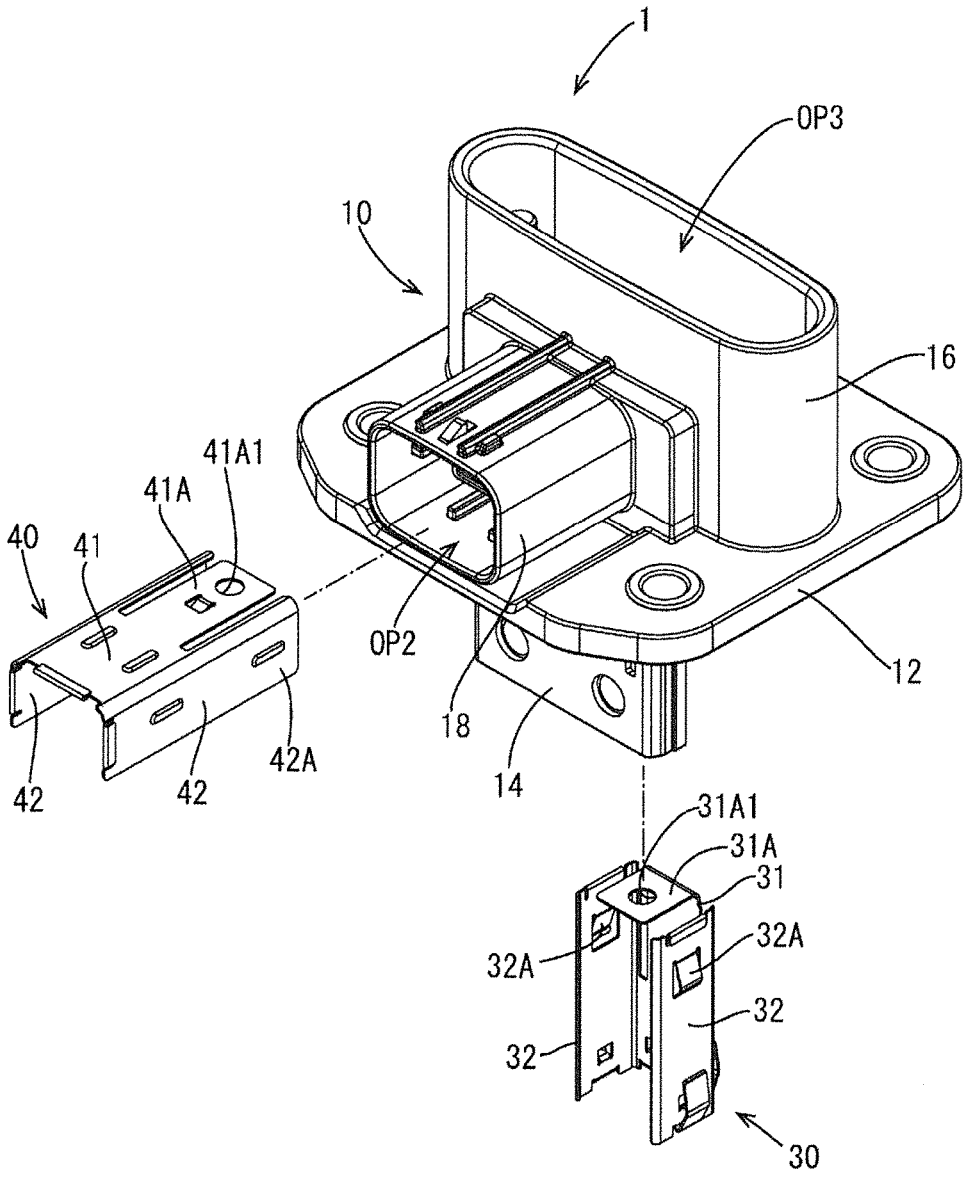
FIG. 1 is an exploded perspective view of a connector according to an embodiment.

As shown in FIG. 1, the housing 10 constituting the connector 1 is in the form of a plate substantially square in a plan view (see FIG. 7) and composed of a plate-like portion 12 to be placed on an outer surface of the device M1 by connecting the connector 1 to the device M1, a hollow cylindrical projecting portion 13 (see FIGS. 4 and 5) slightly projecting downward from the lower surface of the plate-like portion 12, a mounting portion 14 extending downward from the projecting portion 13 and to be mounted into the device M1, a tubular portion 16 having a substantially tube shape and extending upward from the plate-like portion 12 and a receptacle 18 branched from the tubular portion 16 and extending forward. The busbar 20 is pulled out (wires are pulled out) from the receptacle 18.

A seal ring 15 to be held in close contact with the device M1 to seal between the connector 1 and the device M1 by the connector 1 being connected to the device M1 is mounted on the outer peripheral surface of the projecting portion 13 constituting the housing 10. Further, the tubular portion 16 has a substantially elliptical shape long in the lateral direction in a plan view as shown in FIG. 7. The housing 10 is substantially L-shaped as a whole by the mounting portion 14 and the receptacle 18.

Further, as shown in FIGS. 6 and 8, an accommodation space S1 is provided inside the housing 10. This accommodation space S1 includes a first opening OP1 open toward the connection side to the device M1, i.e. downward, a second opening OP2 surrounded by the receptacle 18 and open in a pull-out direction of the busbar 20, i.e. forward, and a third opening OP3 surrounded by the tubular portion 16 and open toward a side opposite to the connection side to the device M1, i.e. upward. Out of these openings OP1, OP2 and OP3, the first and second openings OP1, OP2 communicate with each other in the accommodation space S1.

As shown in FIGS. 6 and 8, a space inside the tubular portion 16 (inside the third opening OP3) in the housing 10 is separated from the accommodation space S1 by a separation wall 16A extending in the front-rear direction from a part of the inner wall of the housing 10. A recess 16A1 open downward is provided in a part of the separation wall 16A located substantially in a center of the third opening OP3. A part of the separation wall where this recess 16A1 is provided is flexible and can be resiliently deformed in the vertical direction by being vertically pressed. Further, busbar mounting portions 16A2 which extend in the front-rear direction from parts of the inner wall of the housing 10 and on which the busbar 20 to be described later is to be mounted are provided on both lateral parts of the separation wall 16A as shown in FIG. 8.

As shown in FIG. 5, six ribs 18A extending in the front-rear direction are provided on the inner wall of the receptacle 18 in the housing 10. Further, an accommodating portion 19 for accommodating a pair of wire-side connecting portions 20C of the busbar 20 to be described later with a front side open is provided to be open forward inside the receptacle 18 (inside the second opening OP2). The accommodating portion 19 extends in the front-rear direction with a predetermined gap formed between the accommodating portion 19 and the receptacle 18 and independently accommodates each of the pair of wire-side connecting portions 20C.

Figure 2:
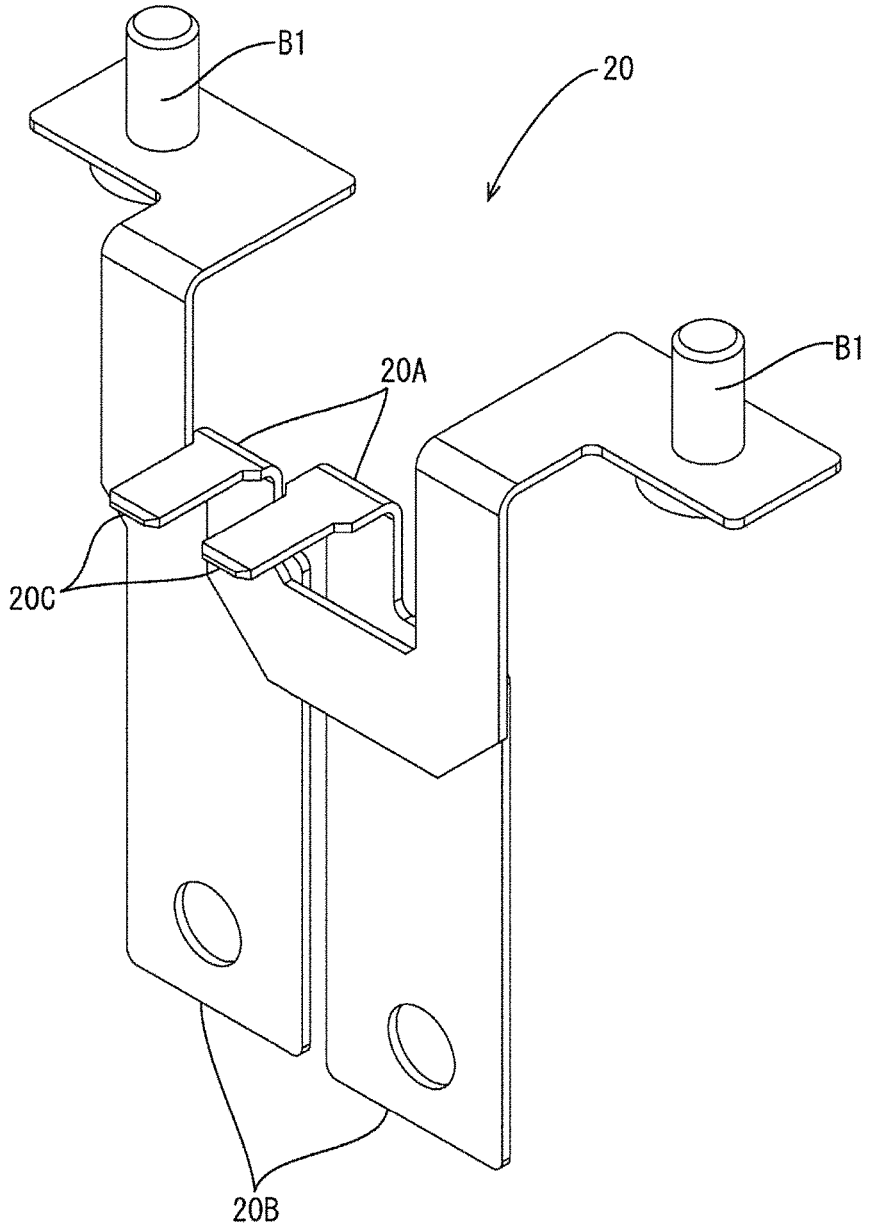
FIG. 2 is a perspective view of a busbar.

The busbar 20 constituting the connector 1 is formed by overlapping a plurality of plate-like terminals made of metal as shown in FIG. 2, parts of the plate-like terminals are bent substantially at a right angle at bent portions 20A and the busbar 20 extends in each of the vertical direction (connecting direction to the device M1) and the front-rear direction by being bent at the bent portions 20A. Out of both ends of the busbar 20, a lower end part is formed into a pair of device-side connecting portions 20B to be connected to the terminals on the side of the device M1 and a front end part is formed into the pair of wire-side connecting portions 20C to be connected to the wires. Note that a dimension of the busbar 20 in the lateral direction is smaller than that of the third opening OP3 in the housing 10 in the lateral direction. In a state accommodated in the accommodation space S1, the busbar 20 has each wire-side connecting portion 20C covered by the shielding shell 50 to be described later.

In the state accommodated in the accommodation space S1, each device-side connecting portion 20B of the busbar 20 is arranged behind the mounting portion 14 in a lower part of the connector 1 and each wire-side connecting portion 20C is pulled out forwardly of the connector 1 and surrounded by the receptacle 18 (see FIG. 5). Further, a pair of first mounting screws B1 are mounted on an upper end part of the busbar 20 as shown in FIG. 2. In the connector 1, as shown in FIG. 8, the pair of first mounting screws B1 of the busbar 20 are mounted in the busbar mounting portions 16A2 of the housing 10 in the accommodation space S1 of the housing 10, whereby the busbar 20 is fixed to the housing 10.

The shielding shell 50 constituting the connector 1 is substantially L-shaped and composed of the first shell member 30 and the second shell member 40. The shielding shell 50 is configured by assembling one end part of the first shell member 30 and one end part of the second shell member 40 in the accommodation space S1 of the housing 10. The shielding shell 50 is for reducing radiation noise radiated from the busbar 20 and the like and a part thereof is grounded to the device side by parts thereof being mounted on the terminals on the device side.

The first shell member 30 constituting the shielding shell 50 is made of conductive metal and in the form of a groove body having one of side surfaces of a rectangular tube body extending straight cut off as shown in FIG. 1. The surface constituting a bottom surface of the groove body out of three side surfaces of the first shell member 30 is referred to as a first bottom surface portion 31 and the surfaces on both sides of the first bottom surface portion 31 are respectively referred to as first side surface portions 32 below.

Engaging portions 32A to be engaged with the one end part of the second shell member 40 are respectively provided on end parts of the both first side surface portions 32 of the first shell member 30 to be assembled with the second shell member 40 as shown in FIG. 1. Each engaging portion 32A serves as a leaf spring by cutting a part of the side surface of the first shell member 30 and bending the cut part outwardly of the first shell member 30. Specifically, each engaging portion 32A serving as a leaf spring is vertically connected to the side surface of the first shell member 30 and a lower side thereof is open.

Further, a first fixing portion 31A to be fixed to the second shell member 40 by a screw is provided on one end part of the first bottom surface portion 31 of the first shell member 30 to be assembled with the second shell member 40 as shown in FIG. 1. The first fixing portion 31A is formed by bending the one end part of the first bottom surface portion 31 substantially at a right angle to extend inwardly of the first shell member 30, and a circular first fixing hole 31A1 is open in a central part thereof.

The second shell member 40 constituting the shielding shell 50 is made of conductive metal similarly to the first shell member 30 and in the form of a groove body having one of side surfaces of a rectangular tube body extending straight cut off as shown in FIG. 1. The surface constituting a bottom surface of the groove body out of three side surfaces of the second shell member 40 is referred to as a second bottom surface portion 41 and the surfaces on both sides of the second bottom surface portion 41 are respectively referred to as second side surface portions 42 below.

One end part of each of the both second side surface portions 42 of the second shell member 40 to be assembled with the first shell member 30 serves as an engaged portion 42A to be engaged with the engaging portion 32A of the first shell member 30 as shown in FIG. 1. Each engaged portion 42A is engaged with the engaging portion 32A by having an inner side pressed and contacted by the engaging portion 32A of the first shell member 30. Note that a plurality of projections 43 slightly projecting outwardly of the second shell member 40 are provided on each side surface of the second shell member 40 by embossing (see FIG. 3).

Further, a second fixing portion 41A to be fixed to the first shell member 30 by a screw is provided on one end part of the second bottom surface portion 41 of the second shell member 40 to be assembled with the first shell member 30. The second fixing portion 41A is cut in the front-rear direction at both sides, thereby being deflectable in the vertical direction. A circular second fixing hole 41A1 is open in a central part of the second fixing portion 41A. An opening diameter of this second fixing hole 41A1 is substantially equal to that of the first fixing hole 31A1 of the first shell member 30 and provided at a position overlapping the first fixing hole 31A1 with the shell member 40 assembled with the first shell member 30.

In the connector 1, a second mounting screw B2 is inserted into the first and second fixing holes 31A1, 41A1 from the insides of the both shell members 30, 40 as shown in FIG. 6 with the first and second shell members 30, 40 assembled in the accommodation space S1 of the housing 10 to configure the substantially L-shaped shielding shell 50, and a tip part of this second mounting screw B2 is inserted into a mounting cap 52 outside the both shell members 30, 40. In this way, the both shell members 30, 40 (first and second fixing portions 31A, 41A) are sandwiched between the second mounting screw B2 and the mounting cap 52 and the both shell members 30, 40 are fixed to each other.

Further, in the connector 1, the above mounting cap 52 is fit and fixed in the recess 16A1 of the separation wall 16A in the accommodation space S1 of the housing 10 as shown in FIG. 6. This causes the shielding shell 50 to be fixed to the housing 10 via the second mounting screw B2.

Next, how to accommodate the first and second shell members 30, 40 into the accommodation space S1 of the housing 10 and how to assemble the both shell members 30, 40 in a manufacturing process of the connector 1 configured as described above are described. Note that the busbar 20 is embedded in the housing 10 in advance by insert molding. In the manufacturing process of the connector 1, the mounting cap 52 is first fit into the recess 16A1 of the separation wall 16A in the housing 10 using a tool from the first opening OP1 before the first and second shell members 30, 40 are accommodated into the accommodation space S1 of the housing 10.

Subsequently, the second shell member 40 is accommodated into the accommodation space S1 of the housing 10 from the second opening OP2 along the front-rear direction of the connector 1. Then, as shown in FIGS. 6 and 8, each projection 43 provided on the second shell member 40 is pressed into contact with each rib 18A provided on the inner wall of the receptacle 18 and the second shell member 40 is engaged with the housing 10 in the accommodation space S1.

Subsequently, the first shell member 30 is accommodated into the accommodation space S1 of the housing 10 from the first opening OP2 along the vertical direction of the connector 1. Then, each engaging portion 32A provided on the first shell member 30 contacts the inner side of each engaged portion 42A of the second shell member 40. As the first shell member 30 is accommodated into the accommodation space S1, each engaging portion 32A is pressed by each engaged portion 42A to be resiliently deformed inwardly. As a result, each engaging portion 32A is pressed in contact with the inner side of each engaged portion 42A by a resilient force thereof and the second shell member 40 is engaged with the first shell member 30 in the accommodation space S1.

Subsequently, the second mounting screw B2 is inserted into each of the first fixing hole 31A1 of the first shell member 30 and the second fixing hole 41A1 of the second shell member 40 using a tool from the first opening OP1, and the tip of the second mounting screw B2 is inserted into the mounting cap 52 fit in the recess 16A1 of the separation wall 16A. In this way, the shielding shell 50 composed of the first and second shell members 30, 40 is fixed to the housing 10. In the above way, the both shell members 30, 40 can be assembled in the accommodation space S1 and the shielding shell 50 can be fixed to the housing 10.

By assembling the first and second shell members 30, 40 in the accommodation space S1 as described above, the substantially L-shaped shielding shell 50 is arranged to extend over separate parts of the busbar 20 in the accommodation space S1 as shown in FIGS. 2 and 10. Here, since one side surface of each of the substantially tubular first and second shell members 30, 40 is cut off and the cut-off part is located inside the shielding shell 50, the shielding shell 50 does not interfere with the busbar 20 in the accommodation space S1 and each wire-side connecting portion 20C of the busbar 20 can be satisfactorily covered by the shielding shell 50.

Next, how to take out the shielding shell 50 from the accommodation space S1 of the housing 10 is described. In taking out the shielding shell 50 from the accommodation space S1, the second mounting screw B2 is detached using the tool or the like from the first opening OP1. This causes the shielding shell 50 to be unfixed from the housing 10.

Subsequently, the recess 16A1 of the separation wall 16A is pressed downwardly using a tool or the like from the third opening OP3. Since this causes the second fixing portion 41A of the second shell member 40 to be pressed downwardly and each projection 43 of the second shell member 40 is separated from each rib 18A of the receptacle 18, the second shell member 40 can be taken out from the accommodation space S1 by pulling out the second shell member 40 forwardly of the housing 10. By pulling out the first shell member 30 downwardly thereafter, the shielding shell 50 can be taken out from the accommodation space S1.

As described above, the connector 1 of this embodiment is a so-called L-shaped connector 1 in which the connecting direction to the device and the pull-out direction of the busbar 20 are perpendicular. Further, in the manufacturing process of the connector 1 of this embodiment, the first shell member extending straight is accommodated into the accommodation space S1 accommodating the busbar 20 from the first opening OP1 to cover the busbar 20 and the second shell member 40 extending straight is accommodated thereinto from the second opening OP2 to cover the busbar 20. This causes the engaging portions 32A provided on the one end part of the first shell member 30 to be engaged with the engaged portions 42A provided on the one end part of the second shell member 40 in the accommodation space S1, and the both shell members 30, 40 are assembled to configure the substantially L-shaped shielding shell 50. As a result, the substantially L-shaped connector 1 with the built-in shielding shell can be realized.

In the connector 1 of this embodiment manufactured in this way, the busbar 20 (wires) can be pulled out in the direction perpendicular to the connecting direction to the device with the side of the connector 1 provided with the first opening OP1 connected to the device and an existing straight connector connected to the side of the connector 1 with the first opening OP2. Thus, a width of the connector 1 of this embodiment in the connecting direction to the device can be suppressed, and space saving can be realized in the connecting direction to the device, for example, as compared to a conventional connector of a shell built-in type from which conductive members such as wires and a busbar are pulled out in a direction parallel to a connecting direction to a device. As just described, the connector 1 of this embodiment can save space while realizing a configuration in which the shielding shell 50 is accommodated in the housing 10.

Further, in the connector 1 of this embodiment, the accommodation space S1 is provided on the side opposite to the connection side to the device and includes the third opening OP3 open at a position facing an assembled part of the first and second shell members 30, 40. Thus, in taking out the shielding shell 50 from the accommodation space S1, the second shell member 40 engaged with the housing 10 can be disengaged using the tool or the like from the third opening OP3.

Although the engaging portions are provided on the one end part of the first shell member and the engaged portions are provided on the one end part of the second shell member in the above embodiment, a configuration for fixing the first and second shell members to each other in an assembled state is not limited.

Although the shielding shell is fixed to the housing by inserting the second mounting screw into the mounting cap in the above embodiment, a configuration for fixing the shielding shell to the housing is not limited.

Although the second shell member is engaged with the housing by pressing each projection of the second shell member into contact with each rib of the receptacle, the first shell member may be engaged with the housing, the both shell members may be engaged with the housing, or neither of the both shell members may be engaged with the housing and the only the shielding shell formed by assembling the both shell members may be engaged with (fixed to) the housing.

Although the accommodation space includes the third opening in the above embodiment, the accommodation space may not include the third opening.

Although the internal space of the third opening is separated from the accommodation space by the separation wall in the above embodiment, this space and the accommodation space may communicate and the mounting and removing of each shell member in the accommodation space may be enabled using a tool or the like from the third opening.

Although one of the side surfaces of each shell member is entirely cut off in the above embodiment, it is sufficient to cut off a part of this surface, which will interfere with the busbar in the accommodation space, and this surface may be partially cut off.

Although the L-shaped connector in which the connecting direction to the device and the pull-out direction of the busbar are perpendicular is illustrated in the above embodiment, the L-shaped connector may be such that the connecting direction to the device and the pull-out direction of the busbar intersect.

Although the embodiment is described in detail above, this is merely an illustration and does not limit the scope of claims. A technique described in claims includes various modifications and alterations of the specific example illustrated above.

LIST OF REFERENCE SIGNS

1 . . . connector
10 . . . housing
12 . . . plate-like portion
14 . . . mounting portion
16 . . . tubular portion
16A . . . separation wall
18 . . . receptacle
18A . . . rib
19 . . . accommodating portion
20 . . . busbar
30 . . . first shell member
31A . . . first fixing portion
31A1 . . . first fixing hole
32A . . . engaging portion
40 . . . second shell member
41A . . . second fixing portion
41A1 . . . second fixing hole
42A . . . engaged portion
43 . . . projection
50 . . . shielding shell
52 . . . mounting cap
B1 . . . first mounting screw
B2 . . . second mounting screw
OP1 . . . first opening
OP2 . . . second opening
OP3 . . . third opening
S1 . . . accommodation space

The invention claimed is:

1. A shielding shell, comprising:

a first shell member shaped to extend straight in an extending direction, the first shield member having opposed first and second ends and at least one engaging portion formed at the first end; and a second shell member shaped to extend straight in a direction normal to the extending direction of the first shell member, the second shell member having opposed first and second ends and having at least one engaged portion formed at the first end, wherein the at least one engaging portion of the first shell member engages the at least one engaged portion of the second shell member to connect the first shell member to the second shell member in such a posture that the first and second shell members are perpendicular to each other.

2. A connector, comprising:

a housing internally provided with an accommodation space including a first opening open in a connecting direction toward a connection side to a device and a second opening open in a pull-out direction substantially normal to the connecting direction, a conductive member electrically connected to the device being pulled out from the second opening in the pull out direction; and a shielding shell shaped to extend in each of the connecting direction to the device and the pull-out direction of the conductive member, arranged in the accommodation space and configured to cover the conductive member in the accommodation space, the shielding shell including a first shell member extending in the connecting direction and having opposed first and second ends and at least one engaging portion formed at the first end and a second shell member extending in the pull-out direction and having opposed first and second ends with at least one engaged portion formed at the first end, wherein the at least one engaging portion of the first shell member engages the at least one engaged portion of the second shell member to connect the first shell member to the second shell member in such a posture that the first and second shell members are perpendicular to each other.

3. The connector of claim 2, wherein:

the conductive member is formed into a busbar extending in each of the connecting direction to the device and the pull-out direction of the conductive member by being partially bent;

the first shell member is provided with a cut open toward the second opening at least in the assembled part with the second shell member in a state where the first shell member is accommodated in the accommodation space; and the second shell member is provided with a cut open toward the first opening at least in the assembled part with the first shell member in a state where the second shell member is accommodated in the accommodation space.

4. The connector of claim 2, wherein the accommodation space further includes a third opening provided on a side opposite to the connection side to the device and open at a position facing an assembled part of the first and second shell members.

5. The connector of claim 4, wherein:

the conductive member is formed into a busbar extending in each of the connecting direction to the device and the pull-out direction of the conductive member by being partially bent;

the first shell member is provided with a cut open toward the second opening at least in the assembled part with the second shell member in a state where the first shell member is accommodated in the accommodation space; and the second shell member is provided with a cut open toward the first opening at least in the assembled part with the first shell member in a state where the second shell member is accommodated in the accommodation space.

* * * * *